US005481973A

United States Patent [19]

Schmid

[11] Patent Number: 5,481,973

[45] Date of Patent: Jan. 9, 1996

[54] DEVICE FOR STIFFENING A ROTARY PRINTING PRESS

[75] Inventor: Gotthard Schmid, Malsch, Germany

[73] Assignee: Heidelberger Druckmaschinen AG, Heidelberg, Germany

[21] Appl. No.: 396,659

[22] Filed: Mar. 1, 1995

[30] Foreign Application Priority Data

Mar. 1, 1994 [DE] Germany ..... 44 06 572.8

[51] Int. Cl.[6] ..... B41F 5/00

[52] U.S. Cl. ..... 101/216; 101/409; 101/479; 101/480

[58] Field of Search ..... 101/212, 216, 101/217, 218, 232, 409, 479, 480, 375

[56] References Cited

U.S. PATENT DOCUMENTS

| | | | |
|---|---|---|---|
| 2,460,504 | 2/1949 | Huebner | 101/479 |
| 3,229,629 | 1/1966 | Conchon et al. | 101/216 |
| 3,633,495 | 1/1972 | Janecek | 101/480 |
| 4,029,009 | 6/1977 | Kühn et al. | 101/409 |
| 4,685,182 | 8/1987 | Lübke | 101/212 |
| 4,852,488 | 8/1989 | Abendroth et al. | 101/409 |
| 5,235,912 | 8/1993 | Wieland | 101/409 |
| 5,345,864 | 9/1994 | Machguth et al. | 101/216 |
| 5,372,068 | 12/1994 | Letmann et al. | 101/375 |

FOREIGN PATENT DOCUMENTS

| | | |
|---|---|---|
| 231036 | 12/1985 | Germany . |
| 3823846 | 1/1990 | Germany . |
| 9200438 | 6/1993 | Germany . |

*Primary Examiner*—Eugene H. Eickholt
*Attorney, Agent, or Firm*—Herbert L. Lerner; Laurence A. Greenberg

[57] ABSTRACT

Device for stiffening a rotary printing press having at least one stock-conducting printing-unit cylinder cooperating with at least one ink-conducting transfer cylinder disposed in accordance with a satellite formation, the cylinders being journalled in side walls of the rotary printing press, includes a stiffening member passing through a hollow space formed in the printing-unit cylinder and having respective end regions, and adapters secured to the side walls wherein the printing-unit cylinder is journalled, the respective end regions of the stiffening member being connected to the adapters, respectively.

6 Claims, 5 Drawing Sheets

DEVICE FOR STIFFENING A ROTARY PRINTING PRESS

BACKGROUND OF THE INVENTION

1. Field of the Invention:

The invention relates to a device for stiffening a rotary printing press, more particularly, with at least one stock-conducting printing-unit cylinder cooperating with at least one ink-conducting transfer cylinder provided in accordance with the satellite principle, the cylinders being accommodated in side walls of the rotary printing press.

An increase in the strength of components is generally achieved in that components by making the components more solid or massive, or by providing them with larger dimensions. It has become known heretofore to provide side walls or frame walls which, in turn, accommodate or carry further components, to be provided with ribs or braces in order to maintain the deformations of the side walls or frame walls within permissible limits. This is, of necessity, associated with a considerable increase in the weight of such components, however. Because compact rotary printing presses are being installed and operated increasingly in office-like environments, limits are imposed upon the implementation of conventional solutions for the purpose of achieving increased stiffness by means of the foregoing measures. Moreover, with regard to assemblies, such as transfer cylinders and form cylinders, which are removable from rotary printing presses, the addition of any bracing causes an obstruction and makes access more difficult.

2. Summary of the Invention:

Proceeding from the above-outlined measures for solving the depicted problem, it is an object of the invention, in the case of rotary printing presses with rotating components having relatively large dimensions, optimally from the standpoints of manufacture and installation, to stiffen carrier or support elements which accommodate the rotating components.

With the forgoing and other objects in view, there is provided, in accordance with the invention, a device for stiffening a rotary printing press having at least one stock-conducting printing-unit cylinder cooperating with at least one ink-conducting transfer cylinder disposed in accordance with a satellite formation, the cylinders being journalled in side walls of the rotary printing press, comprising stiffening means passing through a hollow space formed in the printing-unit cylinder and having respective end regions, and adapters secured to the side walls wherein the printing-unit cylinder is journalled, the respective end regions of the stiffening means being connected to the adapters, respectively.

In accordance with another feature of the invention, the device includes respective cylinder bearings with which the cylinders are journalled in the respective side walls, the adapters, respectively, overlapping the cylinder bearings.

In accordance with a further feature of the invention, the adapters are bell-shaped.

In accordance with an added feature of the invention, the stiffening means extend without contact through the hollow space formed in the printing-unit cylinder.

In accordance with an additional feature of the invention, the hollow space extends in symmetry with a central axis of the printing-unit cylinder.

In accordance with a concomitant feature of the invention, the rotary printing press has at least one plate, blanket and impression cylinder, respectively, having a diameter of given length, and the printing-unit cylinder has a diameter of a length which is a multiple of the given length.

The construction in accordance with the invention ensures that a constant distance is maintained between the side walls accommodating the extralarge-size printing-unit cylinder. After the printing-unit cylinder has been installed, the stiffening means are installable in a relatively simple manner by guiding them through the hollow space of the printing-unit cylinder and fastening them to the adapters. Because the stiffening means cause a considerable increase in the stiffness of the side walls, it is possible to use previously existing assemblies without having to produce new patterns or new molds, for example, in the case of cast components.

The principle of using like components, in turn, assists in the reduction of manufacturing costs. The bracing of the side walls, achievable by the indirect interconnection thereof, results in the absorption of vibrations as well as in the fixed positioning of the transfer cylinders, in the case of the satellite arrangement of the transfer cylinders with respect to the stock-conducting printing-unit cylinder, so that the conditions present in the printing gap remain constant.

The overlapping of the cylinder bearings by the adapters results in the encapsulation of the former against external influences.

Due to the adapters being bell-shaped, and because the flanges of the adapters are bolted to the side-wall surface, a considerably more uniform application of forces to the two side walls is afforded. The flanges of the adapters prevent deformation of the side walls in the region of the bearings of the printing-unit cylinder, due to which, in the case of the satellite-type arrangement of the transfer cylinders, the latter remain in a constant, uniform position with respect to the printing-unit cylinder. Stable conditions consequently exist in the printing gaps of each transfer cylinder which cooperates with the paper-conducting printing-unit cylinder.

Due to the fact that the stiffening means extends without contact through the hollow space of the printing-unit cylinder, relatively easy installation and removal of the stiffening means are achieved.

Because the hollow space through which the stiffening means passes extends symmetrically with respect to or in symmetry with the central axis of the printing-unit cylinder, the production of the latter is particularly favorable from the manufacturing viewpoint.

Other features which are considered as characteristic for the invention are set forth in the appended claims.

Although the invention is illustrated and described herein as embodied in a device for stiffening a rotary printing press, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which:

DESCRIPTION OF THE PREFERRED EMBODIMENTS

Figure 1:
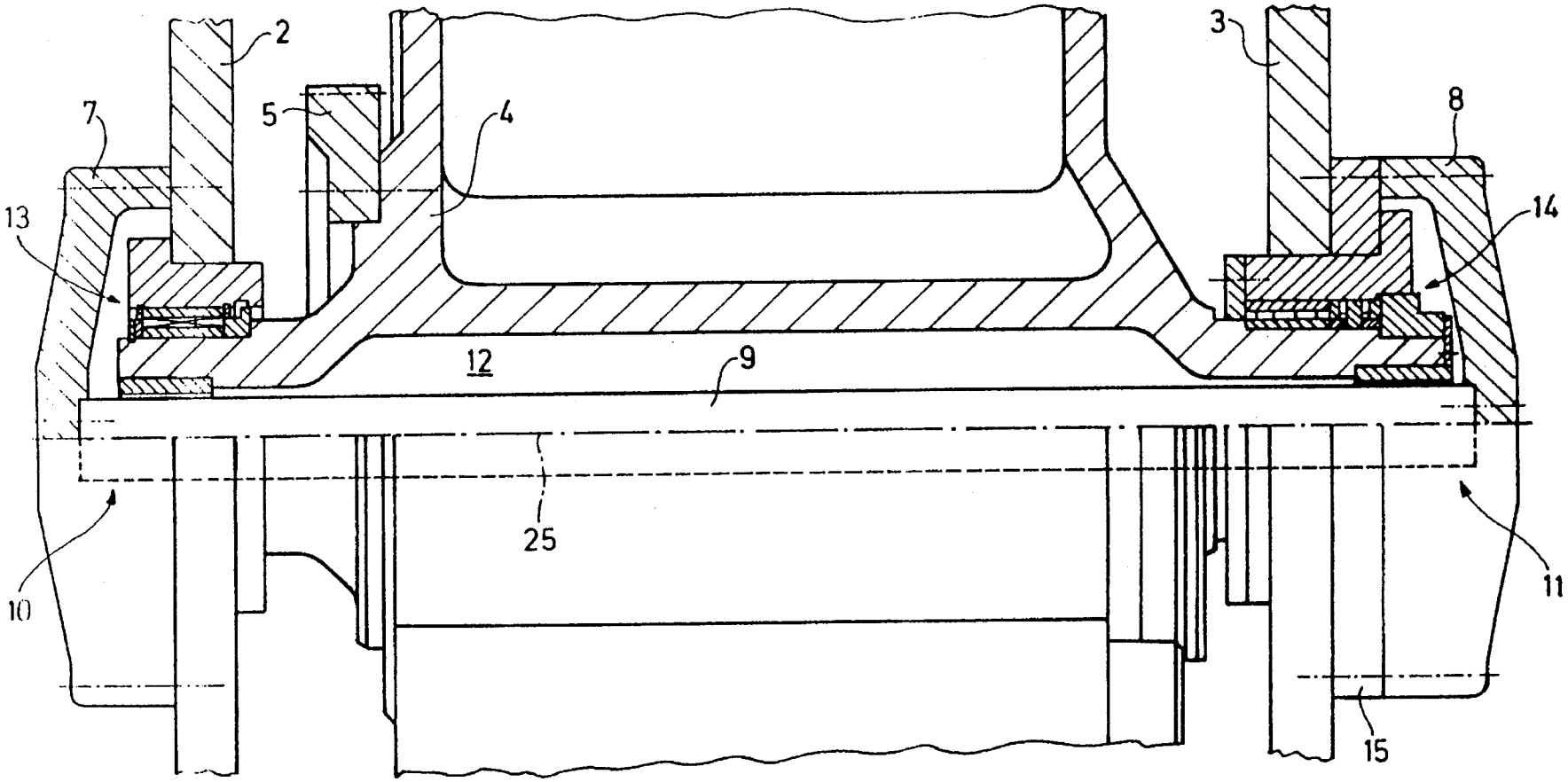
FIG. 1 is a fragmentary longitudinal sectional view of an extralarge-diameter printing-unit cylinder, for example, a printing-unit cylinder having a diameter double or treble that of a conventional printing-unit cylinder, such as an impression, blanket or plate cylinder, supported in journals in drive-side and operating-side side walls of a rotary printing press.

Referring now to the drawings and, first, particularly to FIG. 1 thereof, there is shown therein an extralarge-size printing-unit cylinder, i.e., a cylinder having a diameter which is a multiple of conventional printing-unit cylinders such as impression, blanket or plate cylinders of a rotary printing press, in a fragmentary longitudinal sectional view taken along the central axis 25 thereof. One journal pin of the multi-size printing-unit cylinder 4 is accommodated in a drive-side side wall 2 of a rotary printing press, while the other journal pin of the cylinder 4 is accommodated in an operating-side side wall 3 of the press. The printing-unit cylinder 4 is formed with an elongated hollow space 12 extending symmetrically with respect to the central cylinder axis 25, a stiffening member 9 extending through the elongated hollow space 12 from one end to the other thereof. A helically toothed driving gearwheel 5 is secured at one side of the printing-unit cylinder 4. An axial-force component generated when the printing-unit cylinder 4 is driven by the helically toothed gearwheel 5 is absorbed by an operating-side cylinder bearing 14, which acts as a locating or fixed bearing. A drive-side cylinder bearing 13 constitutes a non-locating or loose bearing which compensates for slight axial movement of the printing-unit cylinder 4.

End regions 10 and 11 of the stiffening means 9 are respectively connected to adapters 7 and 8, respectively; in this case, through a central axis or center line 25 representing a bolted connection. The adapters 7 and 8 are bell-shaped in form and are bolted or screwed to the drive-side and operating-side side walls 2 and 3. An the operating-side side wall 3, a spacer disc 15 is accommodated between the adapter 8 and the side wall 3. By using an inserted spacer disc 15, a cylinder bearing 14 as well as pairs of like adapters 7 and 8 may be used in accordance with the so-called mechanical assembly technique, in order thereby to be able, wherever possible, to fall back on like components, resulting in a considerable reduction in production costs.

Figure 2:
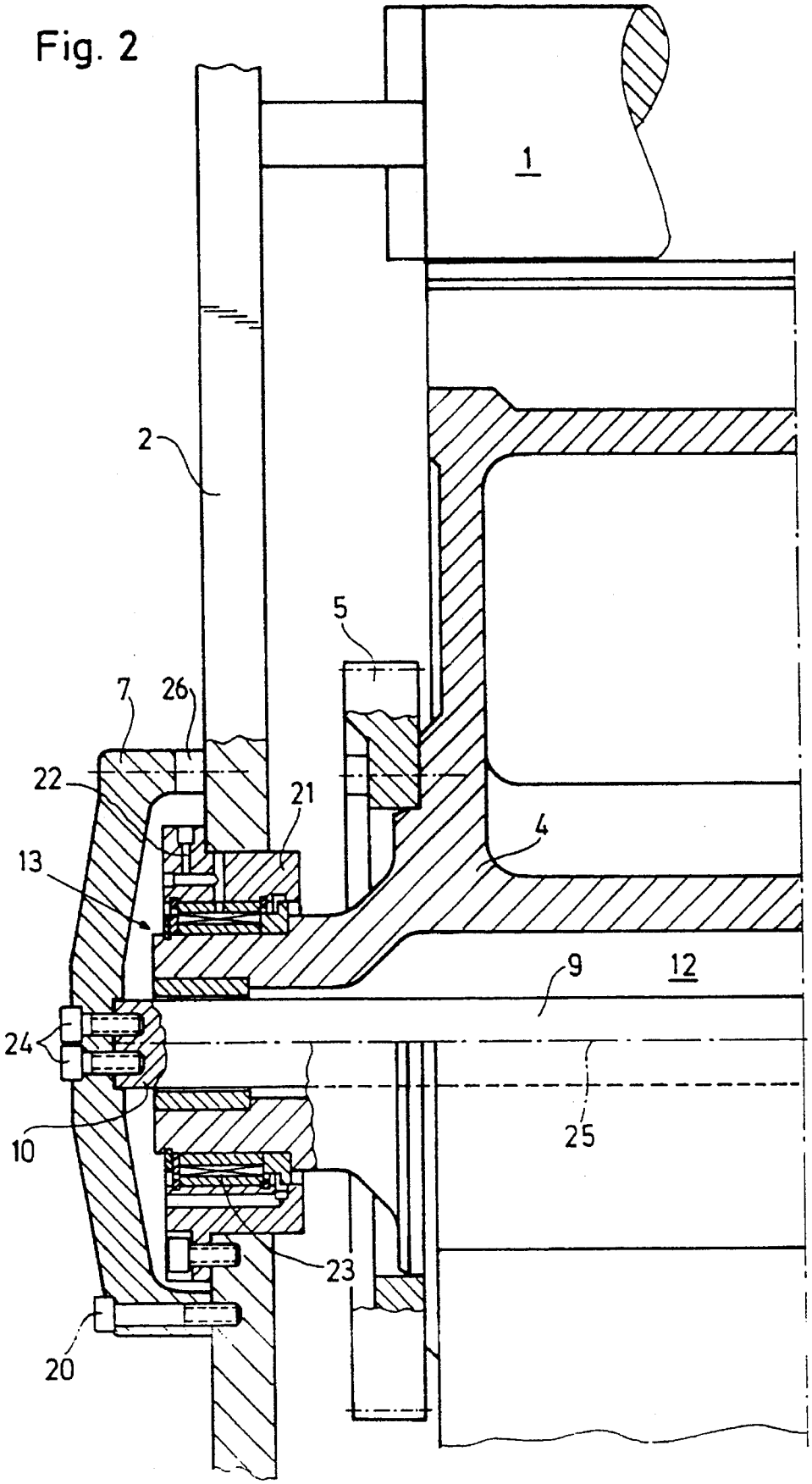
FIG. 2 is an enlarged view of the left-hand or drive side of FIG. 1 showing the journalling of the printing-unit cylinder thereat in greater detail.

FIG. 2 shows the drive-side side wall 2 of a rotary printing press according to the invention.

The printing-unit cylinder 4 provided with a driving gearwheel 5 cooperates with at least one diagrammatically illustrated transfer cylinder 1. If the rotary printing press is configured in accordance with the so-called satellite principle, then up to four ink-conducting transfer cylinders 1 will be disposed at the circumference of the stock-conducting printing-unit cylinder 4.

The drive-side cylinder bearing 13 is formed of a bearing bushing 21 in which a lubricant supply 22 is accommodated. A radial bearing 23 is seated on the cylinder journal of the printing-unit cylinder 4. The cylinder journal shown in FIG. 2 is penetrated by the hollow space 12 in which the end region 10 of the stiffening member 9 is disposed and is connected to the adapter 7 by means of a bolts or screws 24. The adapter 7 covers the cylinder bearing 13, however, it is formed with openings 26 to lubricating points 22 and 19, and is connected to the drive-side side wall 2 through the intermediary of bolts or screws 20.

The operating-side cylinder bearing 14 which corresponds to the drive-side cylinder bearing 13, is accommodated in the side wall 3. The bearing bushing 18 accommodates both a radial bearing 17 and an axial bearing 16, which absorbs the axial-force component of the drive caused by the helically toothed gearwheel 5. The bearing bushing 18 is provided with a lubricant supply 19,.as is the drive-side cylinder bearing 13. The operating-side end region 11 of the stiffening member 9 is connected to the bell-shaped adapter 8 by means of bolts or screws 24, producing an axial bracing between the drive-side and the operating-side side walls 2 and 3, respectively. The bell-shaped construction of the adapters 7 and 8, moreover, permits extensive encapsulation of the cylinder bearings 13 and 14 against external influences, yet permits open access to the lubricating points 19 and 22.

The stiffening member 9 passing through the hollow space 12 formed in the printing-unit cylinder 4 and fastened to the two adapters 7 and 8 ensures the maintenance of a constant distance between the side walls 2 and 3 during operation of the printing press. This means that sidewall components 2 and 3 of smaller wall thickness than required heretofore can be used, thereby affording substantial assistance to the construction principle of like-parts utilization. Furthermore, a decisive advantage of the stiffening member 9, which extends without contact through the rotating mass (in this case, the extralarge-size printing-unit cylinder 4), is that the stiffening of the side walls achieved thereby has the consequence that, given the satellite-type arrangement of the ink transfer cylinders 1 with respect to the extralarge-size printing-unit cylinder 4, there is no possibility of any relative movement between the printing-unit cylinder 4 and the ink transfer cylinders 1. Because the stiffening member 9 is integrated into the interior of the printing-unit cylinder 4, access to the assemblies inside the printing press is not rendered more difficult, a fact which is of enormous significance with regard to the installation or assembly and the removal or disassembly of form and ink transfer cylinders 1. Consequently, access can, moreover, be maintained to the surface of the printing-unit cylinder 4, furthermore permitting any required manual cleaning of the surface of the printing-unit cylinder 4.

Figure 4:
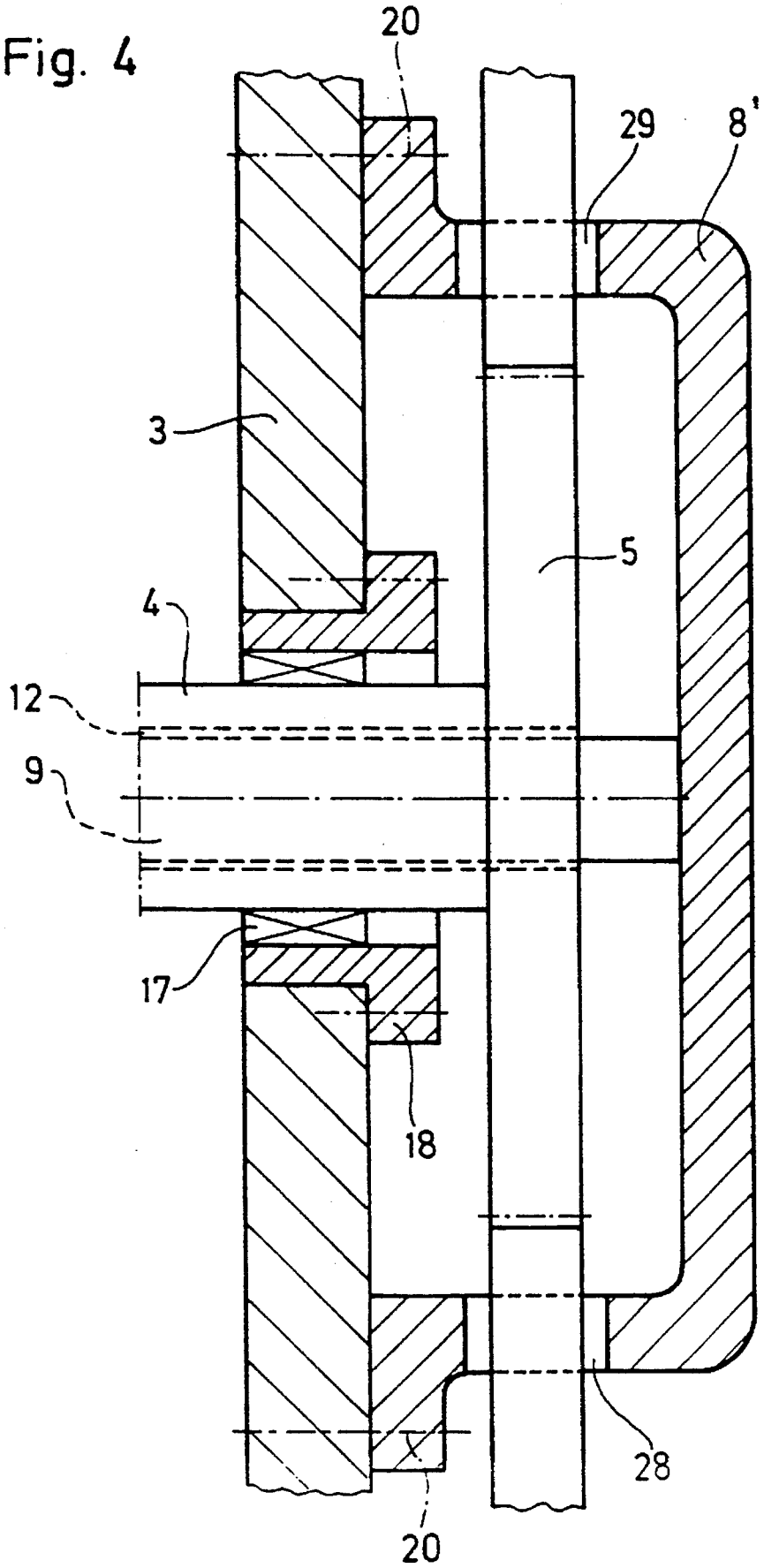
FIG. 4 is an enlarged fragmentary view of FIG. 3 showing a different or modified embodiment wherein an adapter for the respective journal is provided overlapping a gearwheel which is mounted outside the respective side wall of the rotary printing press.

FIG. 4 is a diagrammatic representation of an embodiment of an adapter usable in printing presses having force-transmitting components which are disposed outside of the side walls thereof.

Figure 3:
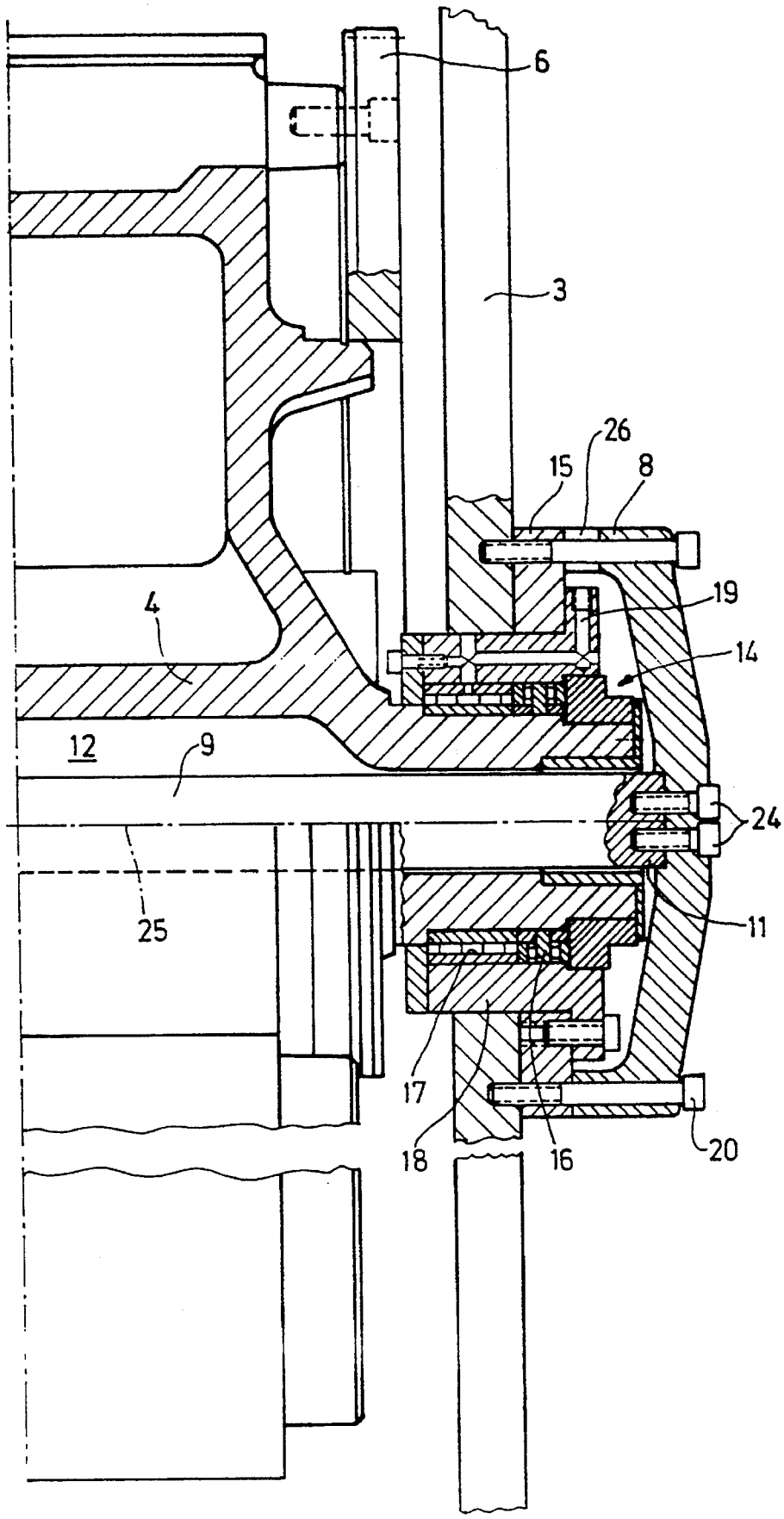
FIG. 3 is an enlarged view of the right-hand or operating side of FIG. 1 showing the journalling of the printing-unit cylinder thereat in greater detail.

The adapter 8' of FIG. 4 which is fastened to the side wall 3 by means of bolts or screws 20, is slightly modified over the adapter 8' of FIG. 3. The adapter 8' is formed with two openings 28 and 29, which may be disposed opposite one another in order to permit the intermeshing of gearwheels. Belt drives would likewise require openings, which, however, might have a somewhat different geometry generally known to a person of ordinary skill in the art.

The gearwheel 5, enclosed by the modified adapter 8' is mounted on the shaft of the printing-unit cylinder 4 which passes through and journalled in the side wall 3. Similarly to the representation thereof shown in FIG. 1, the shaft of the printing-unit cylinder 4 is rotatably mounted or journalled in the radial bearing 17 of the bearing bushing 18 in the side wall 3.

Figure 5:
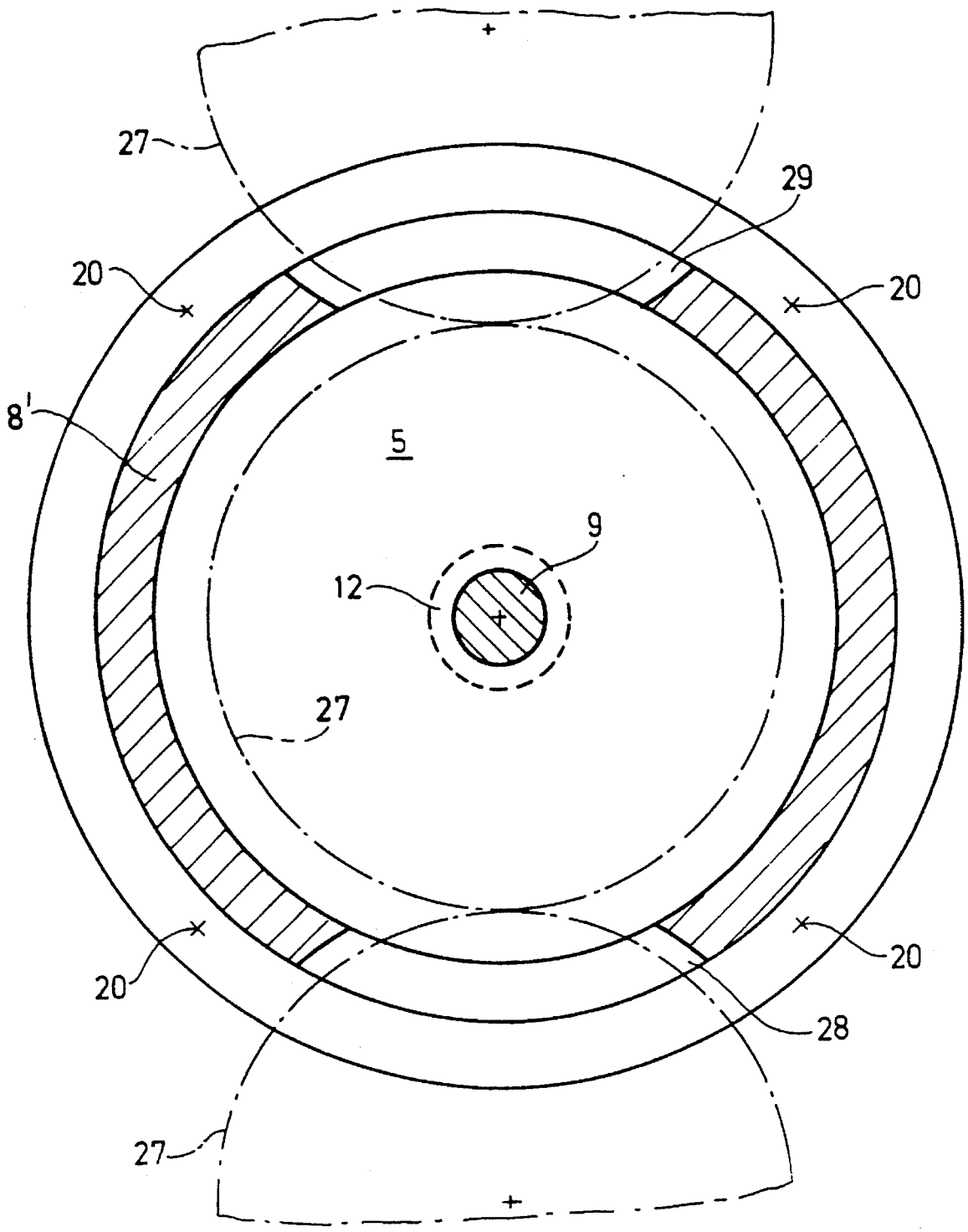
FIG. 5 is a slightly reduced partly cross-sectional, side elevational view of FIG. 4.

FIG. 5 shows the geometry of the modified adapter 8' which is fastened to the side wall 3 by four bolts or screws 20. In the embodiment with the modified adapters 7 and 8, as shown in FIGS. 4 and 5, the stiffening member 9 is connected by means of non-illustrated bolts or screws, as in the embodiment of FIGS. 2 and 3. The stiffening member 9 may be in the form of a round part, and only slightly longer than the stiffening member 9 shown in FIGS. 1, 2 and 3. The openings 28 and 29 of the modified adapter 8' are of such dimensions that the gearwheels, which are represented by the pitch diameter 27 thereof, are able to intermesh.

I claim:

1. Device for stiffening a rotary printing press having at least one stock-conducting printing-unit cylinder cooperating with at least one ink-conducting transfer cylinder disposed in accordance with a satellite formation, the cylinders being journalled in side walls of the rotary printing press, comprising stiffening means passing through a hollow space formed in the printing-unit cylinder and having respective end regions, and adapters secured to the side walls wherein the printing-unit cylinder is journalled, said respective end regions of said stiffening means being connected to said adapters, respectively.

2. Device according to claim 1, including respective cylinder bearings with which the cylinders are journalled in the respective side walls, said adapters, respectively, overlapping said cylinder bearings.

3. Device according to claim 1, wherein said adapters are bell-shaped.

4. Device according to claim 1, wherein said stiffening means extend without contact through said hollow space formed in the printing-unit cylinder.

5. Device according to claim 1, wherein said hollow space extends in symmetry with a central axis of the printing-unit cylinder.

6. Device according to claim 1, wherein the rotary printing press has at least one plate, blanket and impression cylinder, respectively, having a diameter of given length, and wherein the printing-unit cylinder has a diameter of a length which is a multiple of said given length.

* * * * *